US007168966B2

(12) United States Patent
Higuchi et al.

(10) Patent No.: US 7,168,966 B2
(45) Date of Patent: Jan. 30, 2007

(54) CONNECTOR HAVING AN ELASTIC CONNECTING MEMBER HELD BY A BASE INSULATOR AND A FRAME MEMBER

(75) Inventors: Koji Higuchi, Tokyo (JP); Shouji Umesato, Tokyo (JP)

(73) Assignees: Japan Aviation Electronics Industry, Limited, Tokyo (JP); NEC Corporation, Tokyo (JP)

( * ) Notice: Subject to any disclaimer, the term of this patent is extended or adjusted under 35 U.S.C. 154(b) by 0 days.

(21) Appl. No.: 11/204,334

(22) Filed: Aug. 15, 2005

(65) Prior Publication Data

US 2006/0035486 A1 Feb. 16, 2006

(30) Foreign Application Priority Data

Aug. 16, 2004 (JP) ..... 2004-236578

(51) Int. Cl.
*H01R 13/62* (2006.01)

(52) U.S. Cl. ..... 439/157

(58) Field of Classification Search ..... 439/157–160, 439/630, 155
See application file for complete search history.

(56) References Cited

U.S. PATENT DOCUMENTS 5,730,620 A 3/1998 Chan et al.
5,770,891 A 6/1998 Frankeny et al.
6,358,063 B1 3/2002 Neidich
6,508,402 B1 * 1/2003 Takada et al. ..... 235/451
6,669,493 B2 * 12/2003 Kuroda ..... 439/159
6,890,195 B2 * 5/2005 Nagata ..... 439/159
2005/0095886 A1 * 5/2005 Nakamura ..... 439/157

FOREIGN PATENT DOCUMENTS

| | | |
|---|---|---|
| EP | 0574793 | 12/1993 |
| JP | 2002008749 | 1/2002 |
| JP | 2002008810 | 1/2002 |
| WO | WO02/087292 A2 | 10/2002 |

OTHER PUBLICATIONS

European Search Report (enclosed).

* cited by examiner

*Primary Examiner*—J. F. Duverne
(74) *Attorney, Agent, or Firm*—Collard & Roe, P.C.

(57) ABSTRACT

In a connector to be mounted to a mounting object having a frame holding portion, a contact has an elastic member and a conductor coupled to the elastic member. The contact is held by a plate-like base insulator. A frame member holds the base insulator and coupled to a holding member. A slider member is coupled to the holding member and slidable between an engaged position where the slider member is engaged with the frame holding portion and an unengaged position where the slider member is not engaged with the frame holding portion.

14 Claims, 9 Drawing Sheets

CONNECTOR HAVING AN ELASTIC CONNECTING MEMBER HELD BY A BASE INSULATOR AND A FRAME MEMBER

This application claims priority to prior Japanese application JP 2004-236578, the disclosure of which is incorporated herein by reference.

BACKGROUND OF THE INVENTION

This invention relates to a connector adapted to connect two connection objects to each other.

A connector of the type is disclosed in Japanese Unexamined Patent Application Publication (JP-A) No. 2002-8749. The connector comprises an elastic sheet, a plurality of elastic connecting elements protruding from one surface of the elastic sheet, and a metallic ribbon extending through the elastic sheet and each elastic connecting element. The metallic ribbon has one end and the other end exposed on the other surface of the elastic sheet and at an end of each elastic connecting element, respectively. The connector is disposed between a circuit board and a semiconductor package to electrically connect the circuit board and the semiconductor package to each other. Specifically, the one end of the metallic ribbon is connected to an electrode of the circuit board while the other end of the metallic ribbon is connected to an electrode of the semiconductor package.

Another connector of the type is disclosed in Japanese Unexamined Patent Application Publication (JP-A) No. 2002-8810. The connector comprises a holding plate having a plurality of slits, an elastic member inserted through each slit to be supported by the holding plate, and a group of conductive wires extending along the elastic member. The conductive wires are exposed on opposite surfaces of the holding plate. The connector is also disposed between a circuit board and a semiconductor package to electrically connect the circuit board and the semiconductor package to each other.

The above-mentioned connectors often suffer a trouble or malfunction due to disconnection. The disconnection occurs mainly because, when the elastic connecting element or the elastic member is subjected to an excessive load to be excessively displaced, the metallic ribbon or the conductive wires following the elastic connecting element or the elastic member can not withstand such displacement. Further, insufficient connection may be caused to occur due to mechanical shock or presence of dust.

In addition, each of the above-mentioned connectors is disadvantageous also in handlability upon installation. In particular, it is difficult to position the connector with respect to the circuit board. Improper positioning of the connector with respect to the circuit board may cause short-circuiting.

SUMMARY OF THE INVENTION

It is therefore an object of this invention to provide a connector which is easy in maintenance and improved in handlability.

Other objects of the present invention will become clear as the description proceeds.

According to an aspect of the present invention, there is provided a connector to be mounted to a mounting object having a frame holding portion. The connector comprises a contact having an elastic member and a conductor coupled to the elastic member, a plate-like base insulator holding the contact, a frame member holding the base insulator, a holding member coupled to the frame member, and a slider member coupled to the holding member and slidable between an engaged position where the slider member is engaged with the frame holding portion and an unengaged position where the slider member is not engaged with the frame holding portion.

DESCRIPTION OF THE PREFERRED EMBODIMENT

Figure 1:
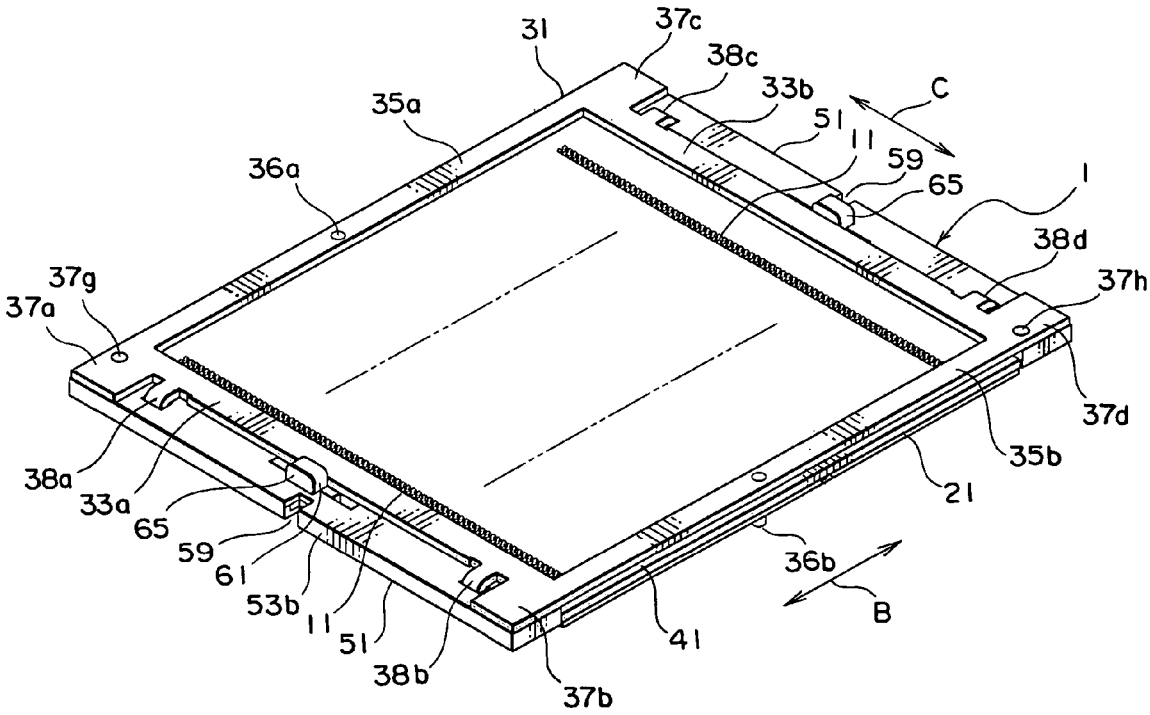
FIG. 1 is a perspective view of a connector according to one embodiment of this invention.
Figure 2:
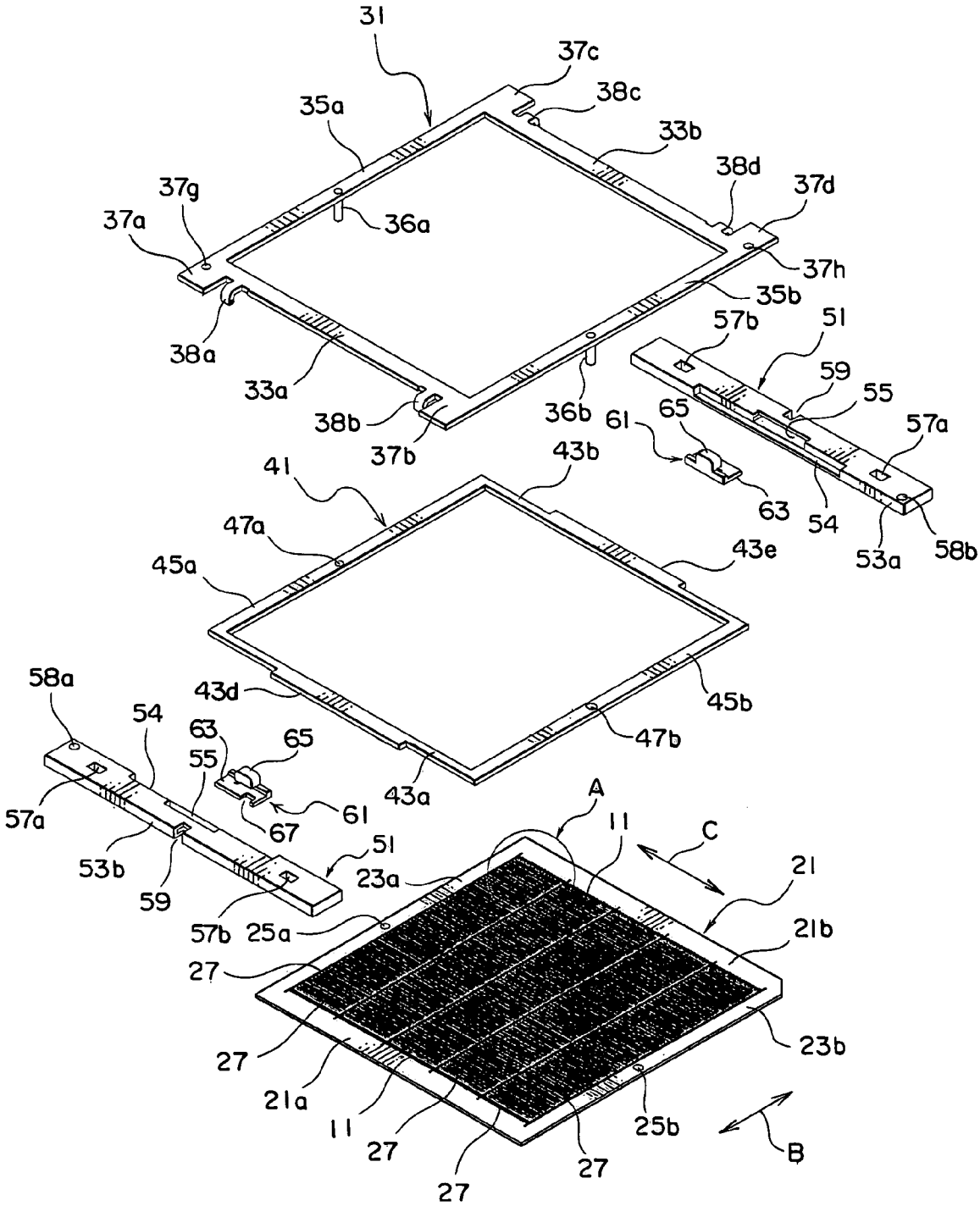
FIG. 2 is an exploded perspective view of the connector illustrated in FIG. 1.

Referring to FIGS. 1 and 2, description will be made of a connector according to an embodiment of this invention.

The connector depicted at 1 in FIG. 1 comprises a plurality of conductive contacts 11 as elastic connecting members, a plate-like base insulator 21 holding the contacts 11, an outer frame member 31 holding the base insulator 21, an inner frame member 41 interposed between the base insulator 21 and the outer frame member 31, and a pair of holding members 51 receiving the inner frame member 41. A combination of the outer and the inner frame members 31 and 41 may be referred to as a frame mechanism or a frame member. Only two of the contacts 11 are illustrated with omission of the other contacts arranged therebetween.

The base insulator 21 is formed by molding a resin material. Each of the outer and the inner frame members 31 and 41 is formed by press-punching and bending a thin metal plate. The holding members 51 are formed by molding a resin material.

Figure 3:
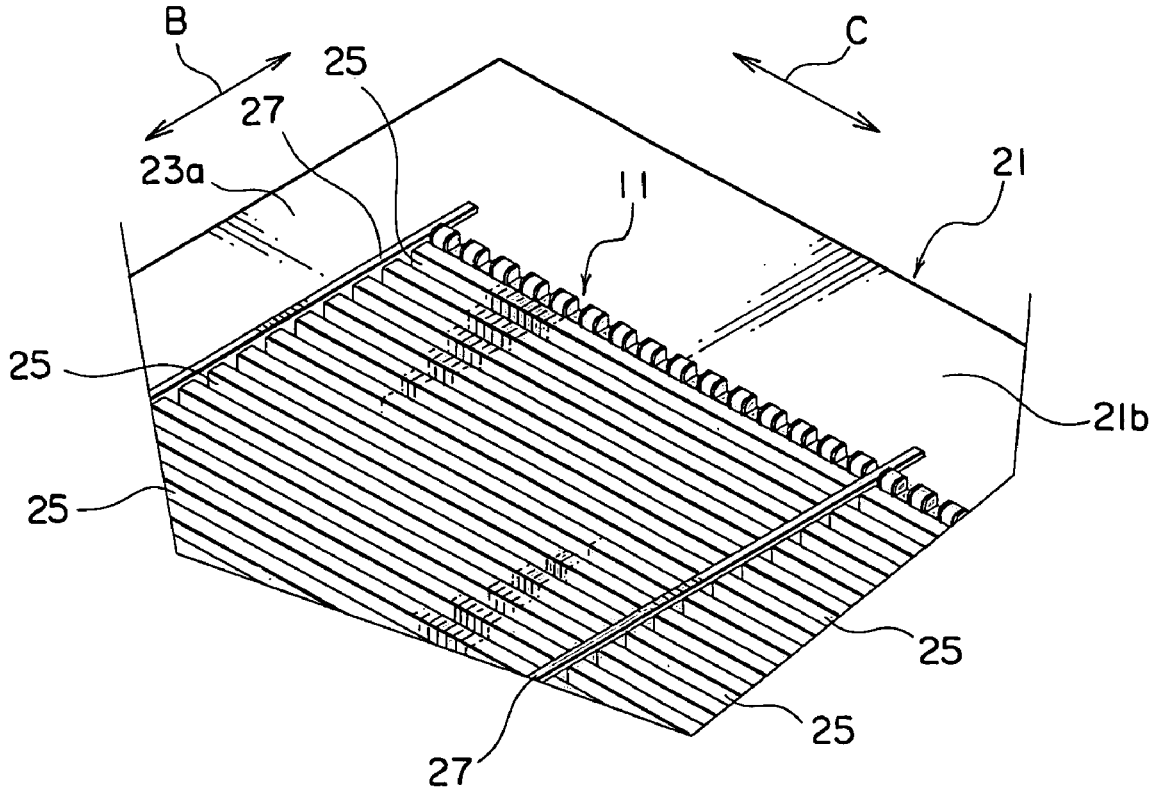
FIG. 3 is an enlarged view of a part A in FIG. 2.
Figure 4A:
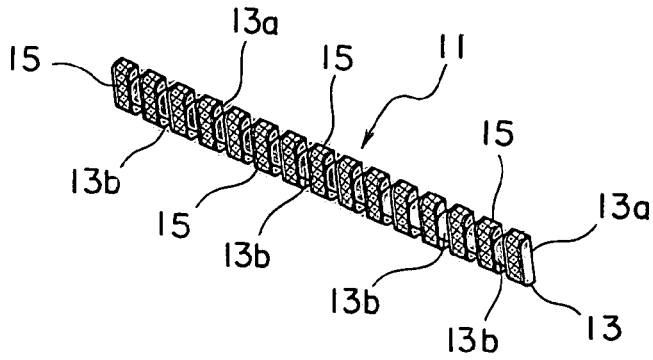
FIG. 4A is an enlarged perspective view of a contact in the connector illustrated in FIG. 1.
Figure 4B:
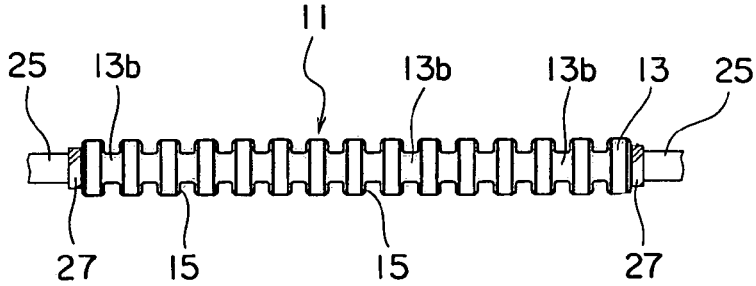
FIG. 4B is a front view of the contact.
Figure 5:
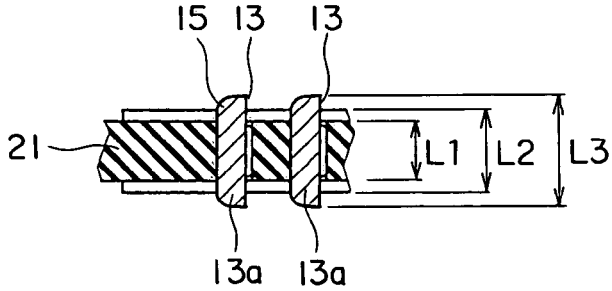
FIG. 5 is a vertical sectional view, in an enlarged scale, of a part of a base insulator with the contact in FIG. 2 fitted thereto.

As will most clearly be understood from FIGS. 3 through 5, each of the contacts 11 comprises an elastic member 13 such as rubber and a metal thin film (conductor) 15 formed on the elastic member 13. The elastic member 13 includes a plurality of principal plate portions 13*a* having a generally flat shape and standing in parallel to one another with a predetermined space kept from one another. The principal plate portions 13*a* are coupled to one another in a first direction C via a plurality of coupling portions 13*b*. The metal thin film 15 is formed on one surface of each principal plate portion 13*a* and a pair of side surfaces adjacent to the one surface. As seen from FIG. 4A, the principal plate portions 13*a* of the elastic member 13, fifteen in number, are coupled in the first direction C to form one contact 11. In FIG. 4A, the metal thin film 15 is shown by a meshed pattern.

The base insulator 21 has a generally rectangular plate-like shape. The base insulator 21 has a pair of base transversal frame portions 21*a* and 21*b* opposite to and parallel to each other in a second direction B (perpendicular to the first direction C) and extending long in the first direction C, a pair of base longitudinal frame portions 23*a* and 23*b* opposite to and parallel to each other in the first direction C and extending long in the second direction B, and a plurality of stopper portions 27 disposed in a region surrounded by the base transversal frame portions 21*a* and 21*b* and the base longitudinal frame portions 23*a* and 23*b*. The stopper portions 27 are spaced from one another in the first direction C and extend in the second direction B. Between every adjacent ones of the stopper portions 27, a plurality of slits 25 are formed. The slits 25 are adjacent to one another in the second direction B. Each slit 25 penetrates the base insulator 21 to its opposite surfaces and extends long in the first direction C. In each slit 25, the contact 11 is press-fitted and held.

Each stopper portion 27 slightly protrudes from the opposite surfaces of the base insulator 21. The base longitudinal frame portions 23*a* and 23*b* are provided with base positioning holes 25*a* and 25*b* formed at intermediate portions in the second direction B, respectively.

As shown in FIGS. 1 and 2, the outer frame member 31 is a generally rectangular frame and has a pair of transversal outer frame portions 33*a* and 33*b* opposite to and parallel to each other in the second direction B and extending long in the first direction C, and a pair of longitudinal outer frame portions 35*a* and 35*b* opposite to and parallel to each other in the first direction C and extending long in the second direction B. The transversal outer frame portions 33*a* and 33*b* are approximately equal in size to the base transversal frame portions 21*a* and 21*b* of the base insulator 21 in the first direction C and in the second direction B. The longitudinal outer frame portions 35*a* and 35*b* are approximately equal in size to the base longitudinal frame portions 23*a* and 23*b* of the base insulator 21 in the first direction C and in the second direction B.

The outer frame member 31 is provided with protruding frame portions 37*a*, 37*b*, 37*c*, and 37*d* formed at four corners thereof and extending outward in the second direction B. Among the protruding frame portions 37*a*, 37*b*, 37*c*, and 37*d*, the two protruding frame portions 37*a* and 37*d* are provided with outer frame positioning holes 37*g* and 37*h*, respectively.

The transversal outer frame portions 33*a* and 33*b* are provided with press-fit portions 38*a*, 38*b*, 38*c*, and 38*d* formed inside the protruding frame portions 37*a*, 37*b*, 37*c*, and 37*d* in the vicinity thereof, respectively. The press-fit portions 38*a*, 38*b*, 38*c*, and 38*d* extend outward from the transversal outer frame portions 33*a* and 33*b* and have end portions which are bent to a position lower than the transversal outer frame portions 33*a* and 33*b*.

The longitudinal outer frame portions 35*a* and 35*b* are provided with a pair of positioning pins 36*a* and 36*b* formed at intermediate portions in the second direction B, respectively. The positioning pins 36*a* and 36*b* protrude from lower surfaces of the longitudinal outer frame portions 35*a* and 35*b* so as to be inserted into the base positioning holes 25*a* and 25*b* in one-to-one correspondence.

As shown in FIG. 2, the inner frame member 41 is a generally rectangular frame and has a pair of transversal inner frame portions 43*a* and 43*b* opposite to and parallel to each other in the second direction B and extending long in the first direction C, and a pair of longitudinal inner frame portions 45*a* and 45*b* opposite to and parallel to each other in the first direction C and extending long in the second direction B.

The transversal inner frame portions 43*a* and 43*b* are faced to the base transversal frame portions 21*a* and 21*b* of the base insulator 21. The transversal inner frame portions 43*a* and 43*b* have a pair of protruding portions 43*d* and 43*e* formed at their intermediate portions in the first direction C and protruding outward from remaining portions of the transversal inner frame portions 43*a* and 43*b*.

The longitudinal inner frame portions 45*a* and 45*b* are approximately equal in size to the base longitudinal frame portions 23*a* and 23*b* of the base insulator 21 in the first direction C and in the second direction B. The longitudinal inner frame portions 45*a* and 45*b* are provided with inner frame positioning holes 47*a* and 47*b* formed at intermediate portions in the second direction B, respectively. The inner frame positioning holes 47*a* and 47*b* correspond to the base positioning holes 25*a* and 25*b* of the base insulator 21 and are adapted to receive the positioning pins 36*a* and 36*b* of the outer frame member 31 to be inserted therethrough.

Referring to FIGS. 1 and 2, the holding members 51 will be described in detail. The holding members 51 have the same shape and are therefore depicted by the same reference numeral.

Each holding member 51 extends long in the first direction C. The holding members 51 have confronting faces 53*a* faced to the transversal inner frame portions 43*a* and 43*b* of the inner frame member 31, and stepped portions 54 formed at intermediate portions of the confronting faces 53*a*, respectively. The stepped portions 54 are approximately equal in size to the protruding portions 43*d* and 43*e* of the inner frame member 41 in the second direction B and in the first direction C so as to receive the protruding portions 43*d* and 43*e* thereon, respectively.

Each stepped portion 54 has a slider receiving portion 56 as a recess formed at its center in the first direction C. Outside the stepped portion 54 in the first direction C, a pair of press-fit holes 57*a* and 57*b* are formed on each holding member 51 to extend from an upper surface to a lower surface. Thus, the holding members 51 have four press-fit holes 57*a* and 57*b* in total to receive the press-fit portions 38*a*, 38*b*, 38*c*, and 38*d* of the outer frame member 31 which are press-fitted therein in one-to-one correspondence.

The holding members 51 are provided with positioning holding holes 58*a* and 58*b*, respectively, each of which is formed in the vicinity of one of opposite ends in the first direction C to penetrate the holding member 51 to opposite surfaces thereof. The positioning holding holes 58*a* and 58*b* correspond to the two outer frame positioning holes 37*g* and 37*h* formed on the protruding frame portions 37*a* and 37*d* of the outer frame member 31, respectively.

Each holding member 51 is provided with an opening portion 59 opposite to the slider receiving portion 55. The opening portion 59 communicates with the slider receiving portion 55. In the slider receiving portion 55, a slider member 61 is fitted to be slidable in the first direction C. The slider member 61 comprises a sliding plate portion 63 inserted into the slider receiving portion 55 and an operating portion 65 formed on the sliding plate portion 63. The operating portion 65 protrudes relative to the outer frame member 31. The sliding plate portion 63 is provided with a cut portion 67 formed at an edge thereof. The cut portion 67 can face the opening portion 59 with the slider member 61 sliding in the first direction C.

Now, assembling of the connector 1 will be described.

Each contact 11 is produced by forming the metal thin film 15 on the elastic member 13 by metal sputtering. Thereafter, the contact 11 is inserted into the slit 25 of the base insulator 21. The base insulator 21 and the inner frame member 41 are combined and bonded together. At this time, the base positioning holes 25*a* and 25*b* of the base insulator 21 are positioned at the inner frame positioning holes 47*a* and 47*b* of the inner frame member 41. The base insulator 21 and the inner frame member 41 are bonded to each other by the use of a double-sided adhesive tape or an adhesive.

Thereafter, the sliding plate portions 63 of the slider members 61 are inserted into the slider receiving portions 55 of the holding members 51. The protruding portions 43*d* and 43*e* of the inner frame member 41 are placed on the stepped portions 54 of the holding members 51. As a consequence, the confronting faces 53*a* of the holding member 51 are brought into contact with edges of the base transversal frame portions 21*a* and 21*b* of the base insulator 21. In a state where the sliding plate portions 63 of the slider members 61 are inserted into the slider receiving portions 55 of the holding members 51, the protruding portions 43*d* and 43*e* of the inner frame member 41 are sandwiched between the sliding plate portions 63 of the slider members 61 and the stepped portions 54.

Next, the outer frame member 31 is placed on the inner frame member 41. At this time, the positioning pins 36*a* and 36*b* of the outer frame member 31 are inserted through the inner frame positioning holes 47*a* and 47*b* of the inner frame member 41 into the base positioning holes 25*a* and 25*b* of the base insulator 21. The press-fit portions 38*a*, 38*b*, 38*c*, and 38*d* of the outer frame member 31 are press-fitted into the press-fit holes 57*a*, 57*b*, 57*c*, and 57*d* of the holding members 51. Thus, the outer frame member 31, the inner frame member 41, and the holding members 51 are integrally combined together so that the inner frame member 41 is prevented from being slipped out and the outer frame member 31 is not easily released.

Further, the positioning pins 36*a* and 36*b* of the outer frame member 31 are inserted through the inner frame positioning holes 47*a* and 47*b* of the inner frame member 41 and the base positioning holes 25*a* and 25*b* of the base insulator 21. Thus, the base insulator 21, the outer frame member 31, and the inner frame member 41 are not easily released from one another.

In the above-mentioned manner, assembling of the connector 1 including the base insulator 21, the outer frame member 31, the inner frame member 41, and the holding members 51 provided with the slider members 61 is completed. The inner frame member 41 serves to correct warping of the base insulator 21 and to improve mechanical strength.

Hereinafter, description will be made of an example of press-fitting the contact 11 into the base insulator 21.

Figure 6:
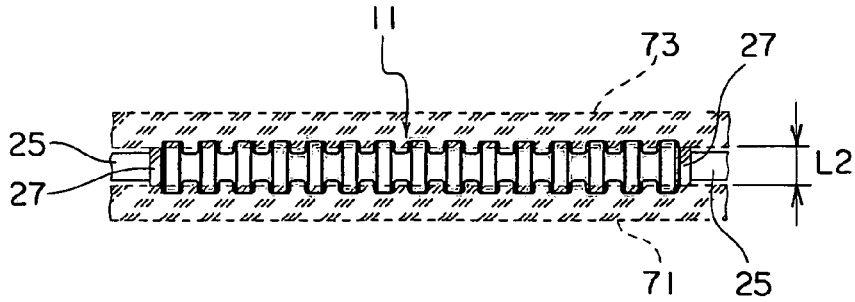
FIG. 6 is a front view of the connector in FIG. 1 when a load is applied thereto.

Referring to FIGS. 5 and 6, it is assumed that the base insulator 21 has a dimension L1 in a thickness direction. The stopper portion 27 has a dimension L2 in a height direction. The contact 11 has a dimension L3 in a height direction 11.

A displacement sufficient for electrical connection of the connector 1 is determined and set. For this purpose, the dimensions L1, L2, and L3 are preliminarily obtained. A load is applied so that printed boards 71 and 73 as connection objects on opposite sides are pressed against the stopper portions 27 having the dimension L2 in the height direction. Even if mechanical shock is given in this state, the mechanical shock is applied to the base insulator 21 so that the elastic member 13 is protected.

Figure 7:
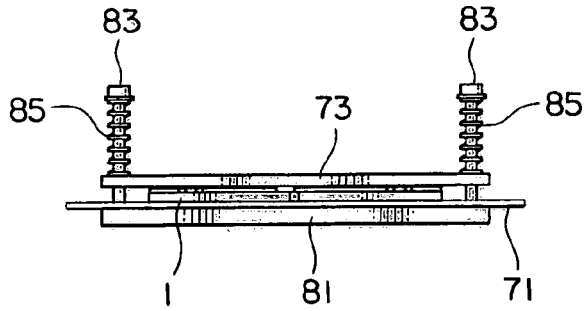
FIG. 7 is a side view of a loading device for applying the load to the connector in FIG. 1.
Figure 8:
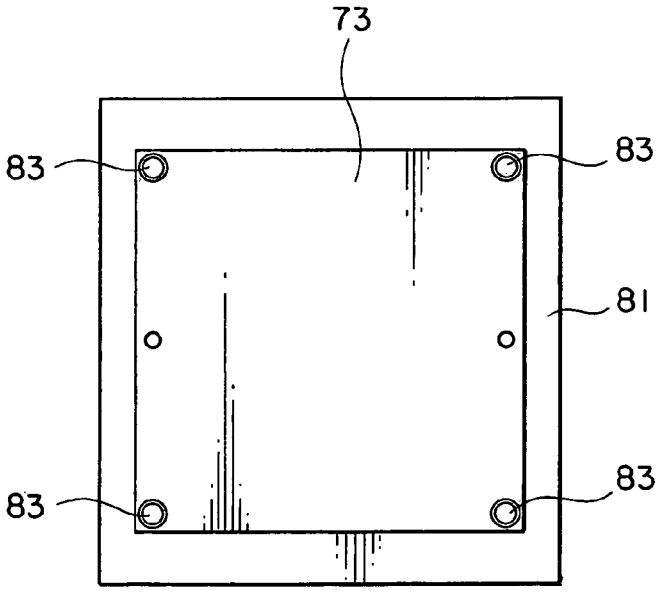
FIG. 8 is a plan view of the loading device illustrated in FIG. 7.

Referring to FIGS. 7 and 8, description will be made of an example of applying the load to the connector 1.

One printed board 71 is placed on a metal stiffener 81. The connector 1 is mounted on the printed board 71. On the connector 1, the other printed board 73 is placed.

At four corners of the metal stiffener 81, four screws 83 stand upright. By driving the screws 83 by a predetermined displacement, coil springs 85 disposed around outer peripheral surfaces of the screws 83 are compressed to thereby apply a predetermined load.

Figure 9:
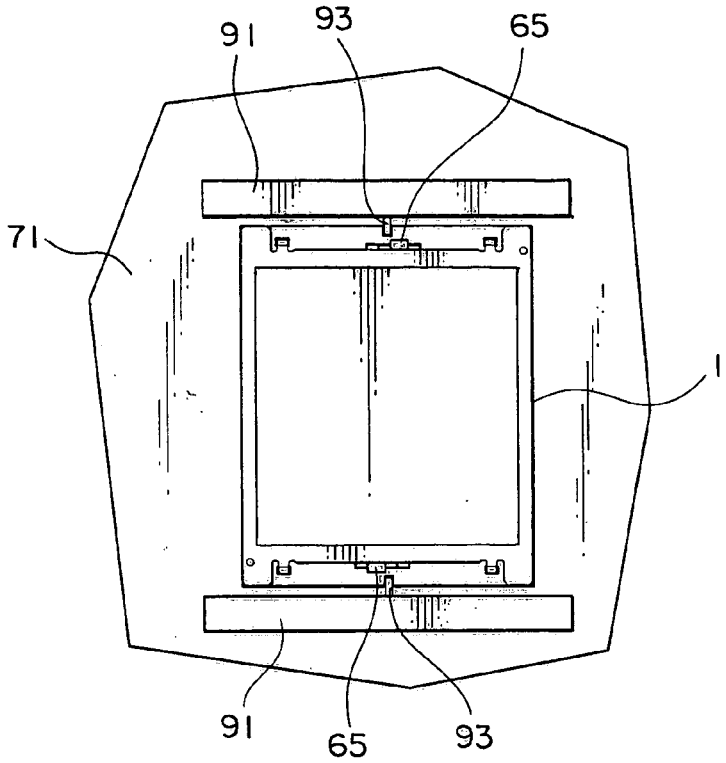
FIG. 9 is a plan view of the connector in FIG. 1 when it is mounted to one printed board.
Figure 10:
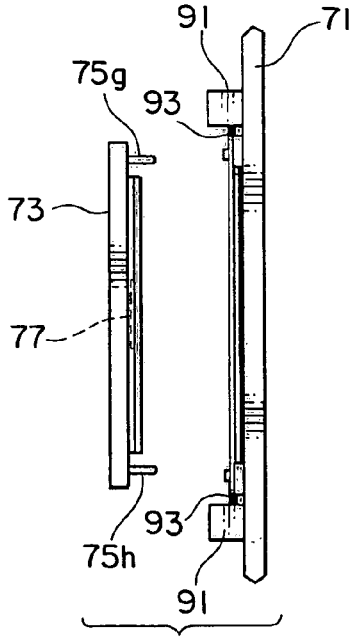
FIG. 10 is a side view showing a state before the other printed board is connected to the connector in FIG. 9.

Referring to FIGS. 9 and 10, on the one printed board 71, a pair of frame holding portions 91 are fixed in parallel to each other with a space left therebetween in the second direction B so as to receive the connector 1 within the space. The frame holding portions 91 have the same shape and are therefore depicted by the same reference numeral.

Between the frame holding portions 91, the connector 1 is disposed. The connector 1 is mounted on the printed board 71. The contact 11 of the connector 1 is contacted with conductive lands (not shown) formed on one surface of the printed board 71. The frame holding portions 91 are provided with pins 93 extending toward each other, respectively. Each pin 93 is long in the second direction B and is inserted into the opening portion 59 of each holding member 51.

The slider member 61 of the holding member 51 is engaged with the frame holding portion 91 and is held by the holding member 51 to be slidable between an engaged position and an unengaged position. When the printed board 71 is arranged at a standing position as illustrated in FIG. 10 after the connector 1 is mounted on the printed board 71, the slider member 61 serves as a temporary retainer to prevent the connector 1 from being released.

Hereinafter, description will be made of an operation of temporarily fixing the connector 1 to the printed board 71 when the printed board 71 is arranged at a standing position.

Figure 11:
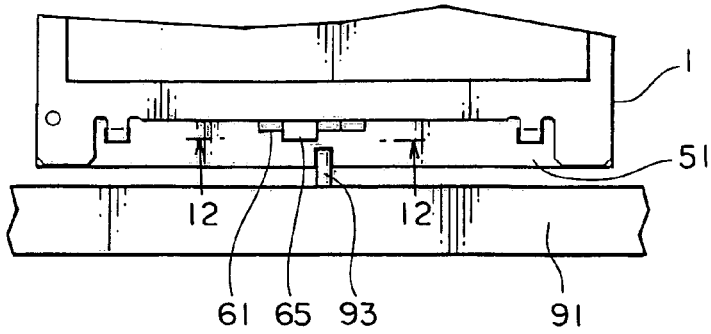
FIG. 11 is an enlarged view of a characteristic part in FIG. 9.
Figure 12:
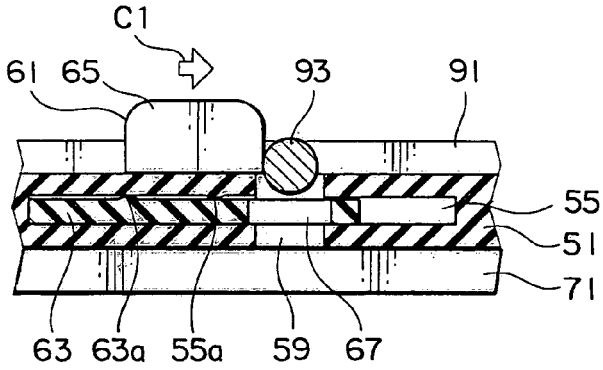
FIG. 12 is a sectional view taken along a line 12—12 in FIG. 11.
Figure 13:
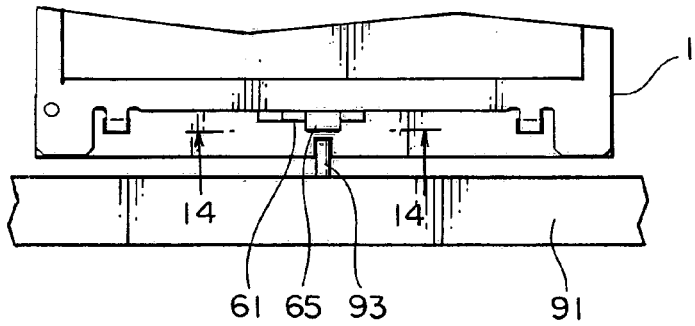
FIG. 13 is a view similar to FIG. 11 after a slider member of the connector in FIG. 9 is operated.
Figure 14:
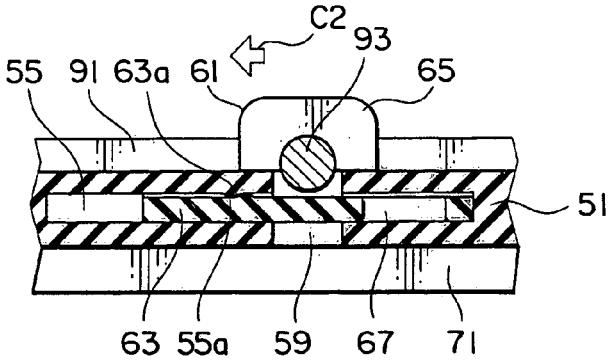
FIG. 14 is a sectional view taken along a line 14—14 in FIG. 13.

FIGS. 11 and 12 show a state before the connector 1 is temporarily fixed to the printed board 71. FIGS. 13 and 14 show a state after the connector is temporarily fixed to the printed board 71.

Referring to FIGS. 11 and 12, in the state before the connector 1 is temporarily fixed to the printed board 71, the cut portion 67 formed in the sliding plate portion 63 of each slider member 61 is faced to the pin 93. Therefore, the connector 1 can easily be released from the printed board 71.

As shown in FIGS. 12 and 14, an inner wall surface of the slider receiving portion 55 is provided with a protrusion 55*a* slightly protruding from the inner wall surface. On the other hand, one surface of the sliding plate portion 63 faced to the inner wall surface of the slider receiving portion 55 is provided with a mating protrusion 63*a* protruding from the one surface.

When the slider member 61 slides from a position shown in FIGS. 11 and 12 in a direction depicted by an arrow C1 in FIG. 12, the sliding plate portion 63 of the slider member 61 is faced to the pin 93. Therefore, the connector 1 and the printed board 71 are put into a temporarily fixed state by the sliding plate portion 63 and the pin 93 faced thereto.

When the slider member 61 is moved in a direction depicted by an arrow C2 in FIG. 14, the temporarily fixed state is canceled. At this time, the mating protrusion 63*a* moves over the protrusion 55*a* and the slider member 61 returns to the position illustrated in FIGS. 11 and 12.

Upon sliding of the slider member 61, click feeling is obtained when the mating protrusion 63*a* moves over the protrusion 55*a*. After the mating protrusion 63*a* moves over the protrusion 55*a*, the mating protrusion 63*a* is engaged with the protrusion 55*a* so that the slider member 61 can not easily moved.

As shown in FIG. 10, the other printed board 73 as a mating printed board is attached to the connector 1. The mating printed board 73 has mating positioning pins 75*g* and 75*h* to be inserted into the outer frame positioning holes 37*g* and 37*h* of the outer frame member 31 and the positioning holding holes 58*a* and 58*b* of the holding members 51 shown in FIG. 2. The mating printed board 73 is provided with a semiconductor chip 77 disposed at its center. By inserting the mating positioning pins 75*g* and 75*h* into the outer frame positioning holes 37*g* and 37*h* of the outer frame member 31 and the positioning holding holes 58*a* and 58*b* of the holding members 51, the mating printed board 73 is attached to the connector 1. The printed board 71 may be called a mounting object to which the connector 1 is to be mounted. The printed board 73 may be called a mating connection object to be connected to the connector 1.

Figure 15:
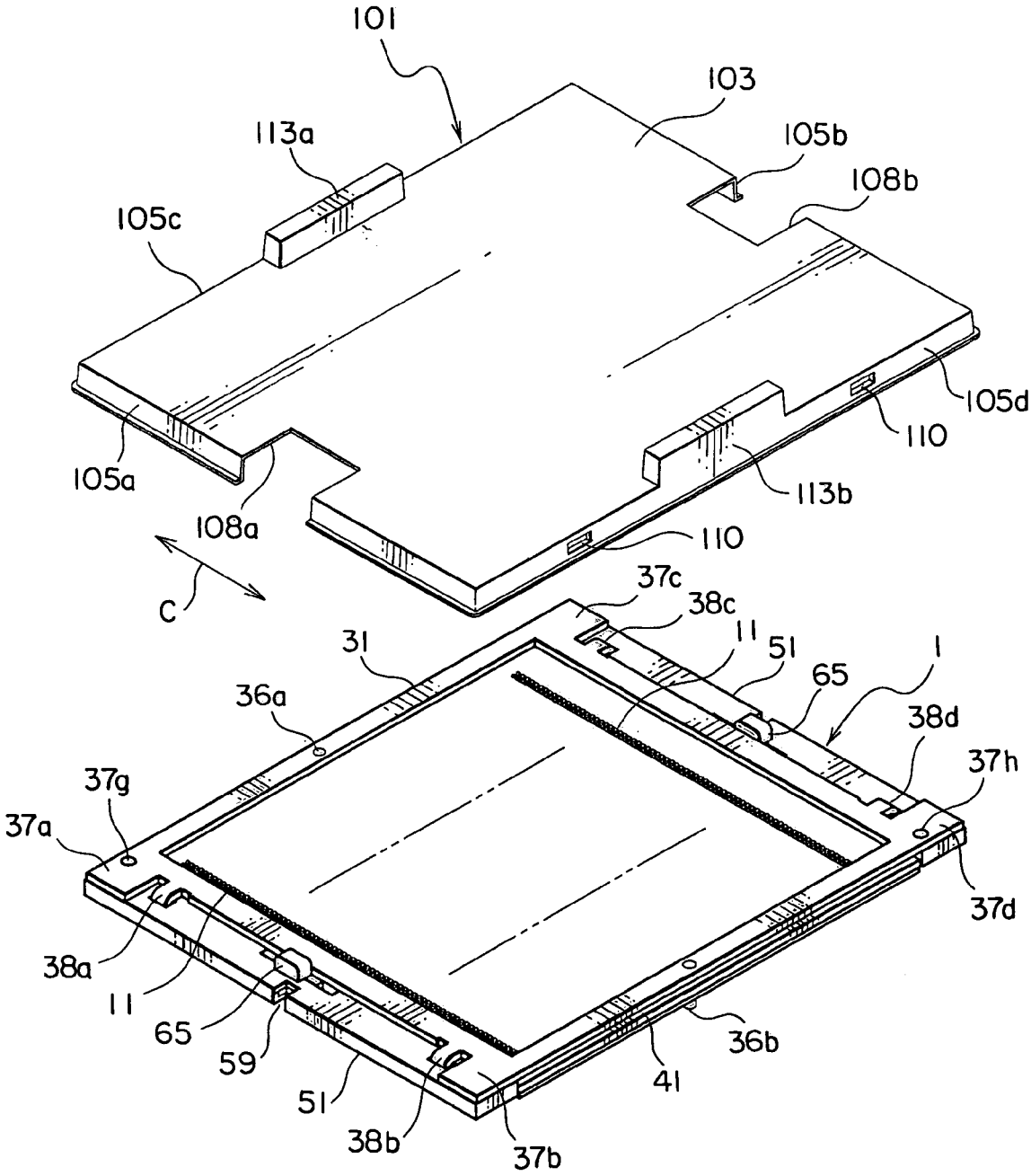
FIG. 15 is a perspective view of the connector in FIG. 1 and a cover member to cover the connector in a separated state.

FIG. 15 shows the connector 1 and a cover member 101 covering the connector 1. The cover member 101 has a cover main portion 103 faced to exposed parts of each contact 11, the outer frame member 31, and the holding members 51 of the connector 1, a pair of transversal peripheral surface portions 105*a* and 105*b* faced to side surfaces of the base insulator 21, the outer frame member 31, and the holding members 51, and a pair of longitudinal peripheral surface portions 105*c* and 105*d* opposite to and parallel to each other in the first direction C.

Figure 16:
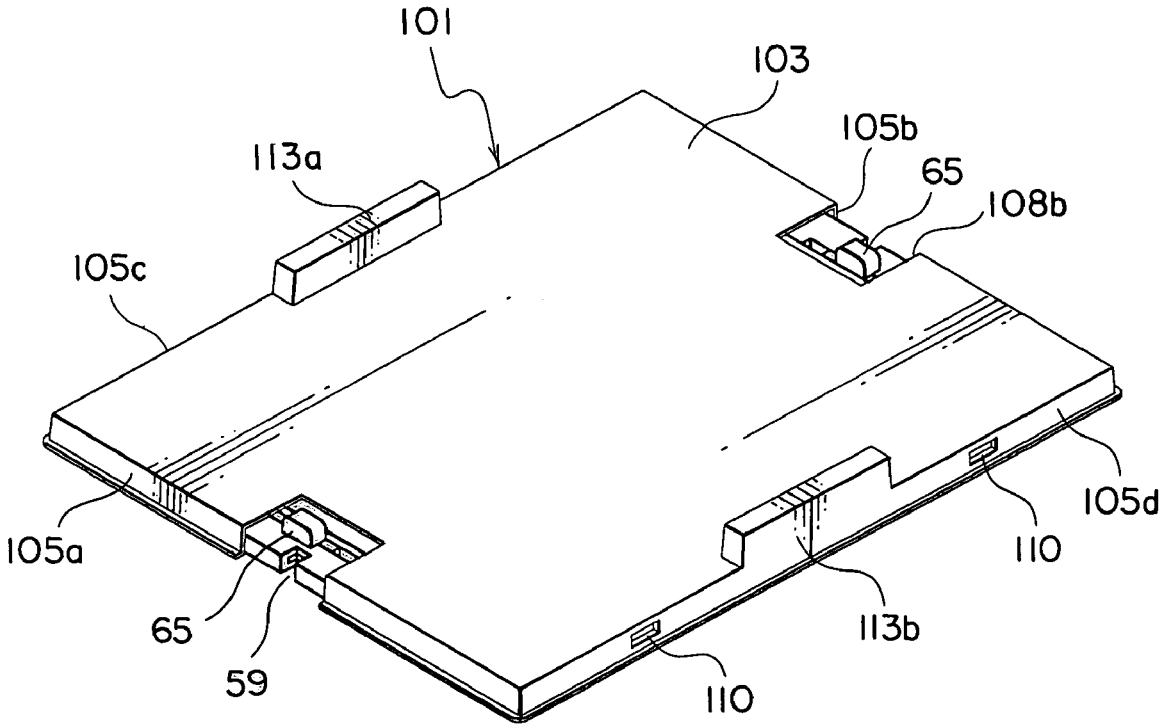
FIG. 16 is a perspective view of the connector in FIG. 1 when it is covered with the cover member.

The cover member 101 is provided with cover cut portions 108*a* and 108*b* extending from the transversal peripheral surface portions 105*a* and 105*b* to the cover main portion 103 so that the slider members 61 and parts of the holding members 51 including the opening portions 59 are exposed when the cover member 101 is put on the connector 1 as shown in FIG. 16. The longitudinal peripheral surface portions 105*c* and 105*d* are provided with a plurality of cover protruding portions 110 protruding inward. The cover main portion 103 is provided with a pair of gripping portions 113*a* and 113*b* extending along the longitudinal peripheral surface portions 105*c* and 105*d* and protruding upward from the cover main portion 103.

The cover member 101 as a whole is a thin plate preliminarily subjected to antistatic treatment. For example, the cover member 101 is produced by vacuum forming. The cover cut portions 108*a* and 18*b* and the cover protruding portions 110 are formed by secondary working. The cover protruding portions 110 have a size such that the cover protruding portions 110 are fitted to side surfaces of the connector 1.

Immediately before the connector 1 is mounted to the printed board 71, the cover member 101 is kept attached to the connector 1. When the connector 1 is covered with the cover member 101, the transversal peripheral surface portions 105*a* and 105*b* and the longitudinal peripheral surface portions 105*c* and 105*d* are faced to the side surfaces of the connector 1. At this time, the cover protruding portions 110 are press-contacted with the side surfaces of the connector 1. Since the connector 1 is covered with the cover member 101, it is possible to prevent adhesion of dust to the contacts 11 and the slits 27.

When the connector 1 is mounted to the printed board 71, the cover member 101 is removed from the connector 1. The gripping portions 113*a* and 113*b* are held by operator's fingers and pressed towards each other. Then, with deformation of the cover main portion 103, the transversal peripheral surface portions 105*a* and 105*b* and the longitudinal peripheral surface portions 105*c* and 105*d* are slightly deformed outward so that the cover protruding portions 110 are separated and released from the side surfaces of the connector 1. As a consequence, the cover member 101 can easily be removed from the connector 1.

The above-mentioned connector may effectively be used in case where a semiconductor package of a surface-mount type is electrically connected to various types of printed boards and in case where a semiconductor package is electrically connected to a testing circuit board.

Preferably, the metal thin film 15 is formed on the surface of the contact 11 by metal plating or metal sputtering. The stopper portion 27 for preventing excessive deformation due to excessive compression is desired to have a structure such that an area to be brought into contact with the mating printed board 73 is as large as possible. In particular, an increase in area is effective in case where the connector 1 has a large size or in case where warping of the printed board 71 is large.

While the present invention has thus far been described in connection with the preferred embodiment thereof, it will readily be possible for those skilled in the art to put this invention into practice in various other manners. The elastic member 13 is made of rubber in the foregoing description but may be made of gel. The above-mentioned connector 1 may be implemented as a double-side connector known in the art. Each of the outer frame member 31, the inner frame member 41, the holding members 51, and the slider members 61 may be formed not only by a metal material but also by a resin material via molding as far as a sufficient mechanical strength is assured.

What is claimed is:

1. A connector to be mounted to a mounting object having a frame holding portion, the connector comprising:

a contact having an elastic member and a conductor coupled to the elastic member;

a plate-like base insulator holding the contact;

a frame member holding the base insulator;

a holding member coupled to the frame member; and a slider member coupled to the holding member and slidable between an engaged position where the slider member is engaged with the frame holding portion and an unengaged position where the slider member is not engaged with the frame holding portion.

2. The connector according to claim 1, wherein the frame member comprises:

an outer frame member holding the base insulator; and an inner frame member interposed between the base insulator and the outer frame member, the holding member receiving the inner frame member.

3. The connector according to claim 2, wherein the base insulator has a base positioning hole, the inner frame member having an inner frame positioning hole, the outer frame member having a positioning pin to be inserted through the base positioning hole and the inner frame positioning hole.

4. The connector according to claim 2, wherein the outer frame member has an outer frame positioning hole to insert a mating positioning pin of a mating connection object to be connected to the connector, the holding member having a positioning holding hole to insert the mating positioning pin.

5. The connector according to claim 2, wherein the inner frame member has a protruding portion protruding to face the holding member, the holding member having a stepped portion to receive the protruding portion.

6. The connector according to claim 2, wherein the holding member having a slider receiving portion as a recess to incorporate the slider member.

7. The connector according to claim 6, wherein the frame holding portion has a pin to be engaged with the slider member, the slider member having a sliding plate portion to be inserted into the slider receiving portion and an operating portion coupled to the sliding plate portion, the sliding plate portion having a cut portion corresponding to the pin.

8. The connector according to claim 7, wherein the holding member has an opening portion to allow insertion of the pin into the slider receiving portion.

9. The connector according to claim 2, wherein the holding member has a plurality of press-fit holes, the outer frame member having a plurality of press-fit portions to be press-fitted to the press-fit holes, respectively.

10. The connector according to claim 1, wherein the base insulator has a plurality of slits and a plurality of stopper portions separating the slits, the slits penetrating the base insulator to opposite surfaces thereof, each of the slits receiving the contact press-fitted therein, the stopper portions protruding from the opposite surfaces of the base insulator.

11. The connector according to claim 1, further comprising a cover member having a cover main portion faced to exposed surfaces of the contact, the outer frame member, and the holding member and a peripheral surface portion faced to the side surfaces, the peripheral surface portion having a plurality of cover protruding portions protruding inward so as to engage the side surfaces in press contact therewith when the peripheral surface portion is faced to the side surfaces.

12. The connector according to claim 11, wherein the cover member has a cover cut portion extending from the peripheral surface portion to the cover main portion to expose the slider member.

13. The connector according to claim 12, wherein the sliding plate portion has an opening portion formed at a position corresponding to the cover cut portion to receive the frame holding portion.

14. The connector according to claim 11, wherein the cover main portion has a gripping portion formed near the peripheral surface portion.

* * * * *